US005371571A

United States Patent [19]

Asanae

[11] Patent Number: 5,371,571

[45] Date of Patent: Dec. 6, 1994

[54] PORTABLE ELECTROPHOTOGRAPHIC PRINTER OF REDUCED HEIGHT

[75] Inventor: Masumi Asanae, Kumagaya, Japan

[73] Assignee: Hitachi Metals, Ltd., Tokyo, Japan

[21] Appl. No.: 32,242

[22] Filed: Mar. 17, 1993

[30] Foreign Application Priority Data

Mar. 18, 1992 [JP] Japan ..... 4-060757

[51] Int. Cl.[5] ..... G03G 15/00

[52] U.S. Cl. ..... 355/200; 355/211; 355/245; 355/260; 355/285

[58] Field of Search ..... 355/200, 210, 211, 245, 355/285, 289, 290, 260, 203-209

[56] References Cited

U.S. PATENT DOCUMENTS

| | | | |
|---|---|---|---|
| 4,766,463 | 8/1988 | Wataniki et al. | 355/272 |
| 4,954,845 | 9/1990 | Yano et al. | 355/290 |
| 4,996,566 | 2/1991 | Morita et al. | 355/246 |
| 5,107,304 | 4/1992 | Haneda et al. | 355/296 |
| 5,126,800 | 6/1992 | Shishido et al. | 355/211 |
| 5,126,913 | 6/1992 | Araya et al. | 361/225 |
| 5,138,390 | 8/1992 | Miyabayashi et al. | 355/283 |
| 5,177,534 | 1/1993 | Kisu et al. | 355/219 |
| 5,243,395 | 9/1993 | Koike et al. | 355/327 |

FOREIGN PATENT DOCUMENTS

| | | |
|---|---|---|
| 60-207170 | 10/1985 | Japan . |
| 63-63070 | 3/1988 | Japan . |
| 2-161452 | 6/1990 | Japan . |

*Primary Examiner*—A. T. Grimley
*Assistant Examiner*—T. A. Dang
*Attorney, Agent, or Firm*—Finnegan, Henderson, Farabow, Garrett & Dunner

[57] ABSTRACT

The electrophotographic printer having a cylindrical, electrostatic latent image-bearing member, an electrostatic latent image-forming means, a developing means equipped with a magnet roll for conveying a magnetic developer, a transfer means for transferring the developed image on the surface of the latent image-bearing member onto a recording medium, a cleaning means for cleaning the surface of the latent image-bearing member after transferring of the developed image, and a fixing means disposed downstream of the latent image-bearing member for heat-fixing the developed image onto the recording medium, wherein an outer diameter of the latent image-bearing member is 40 mm or less, an outer diameter of the magnet roll is 30 mm or less, and a height of the image-forming unit is 60 mm or less.

5 Claims, 1 Drawing Sheet

PORTABLE ELECTROPHOTOGRAPHIC PRINTER OF REDUCED HEIGHT

BACKGROUND OF THE INVENTION

The present invention relates to an electrophotographic printer utilizing an electrostatic latent image developing means for forming an electrostatic latent image corresponding to information to be printed, on an image-bearing member, developing the electrostatic latent image with a magnetic developer containing magnetic toner, transferring the developed image to a recording medium, and heat-fixing the developed image to the recording medium, and more particularly to an improved thin electrophotographic printer which can be conveniently carried with hand.

In a conventional electrophotographic printer, an electrostatic latent image corresponding to a printer output (information to be printed) is generally formed on a cylindrical photosensitive drum, brought into contact with a magnetic brush of a magnetic developer conveyed on a developing roll containing a permanent magnet roll and disposed opposite the photosensitive drum, so that it is developed (visualized as a toner image). The developed image is then transferred onto a recording paper and heat-fixed.

The magnetic developer usable for a magnetic brush method as mentioned above is in many cases a two-component developer consisting of a magnetic carrier and a non-magnetic toner. However, in the case of using such a two-component developer, a concentration sensor and other members are required, failing to miniaturizing an electrophotographic printer satisfactorily. Accordingly, a one-component developer consisting of a magnetic toner, or a magnetic developer consisting of a magnetic toner and a magnetic carrier is mostly used for the electrophotographic printer.

With the above magnetic developer, the electrophotographic printer can be miniaturized to some extent, but there is a limit in the conventional electrophotographic printer. That is, since the conventional electrophotographic printer has a heat-fixing means comprising a heat roll containing a heat source and a pressure roll for pressing the recording paper to the heat roll, and since these rolls are provided with paper-separating fingers and other accessories, it is impossible to reduce the height of the roll pair of the heat-fixing means drastically. Accordingly, it has been impossible to make the conventional electrophotographic printer have an extremely reduced thickness.

Further, an increasingly higher demand is recently appreciated on a portable (hand-carrying) electrophotographic printer. Such a portable electrophotographic printer has already been commercialized for a type of using heat-sensitive papers. However, the information or image recorded on the heat-sensitive papers will disappear as the time goes. Accordingly, for the purpose of printing information which should be kept for a long period of time, the heat-sensitive paper type electrophotographic printer is not suitable.

OBJECT AND SUMMARY OF THE INVENTION

Accordingly, an object of the present invention is to provide a thin, hand-carryable electrophotographic printer free from the above problems inherent in the conventional electrophotographic printer.

To achieve the above object, the present invention provides an electrophotographic printer comprising a cylindrical, electrostatic latent image-bearing member, an electrostatic latent image-forming means, a developing means disposed near the electrostatic latent image-bearing member and equipped with a magnet roll for conveying a magnetic developer, a transfer means disposed near the electrostatic latent image-bearing member for transferring the developed image on the surface of the electrostatic latent image-bearing member onto a recording medium, a cleaning means disposed near the electrostatic latent image-bearing member for cleaning the surface of the electrostatic latent image-bearing member after transferring of the developed image, and a fixing means disposed downstream of the electrostatic latent image-bearing member for heat-fixing the developed image onto the recording medium, wherein an outer diameter of the electrostatic latent image-bearing member is 40 mm or less, an outer diameter of the magnet roll is 30 mm or less, and a height of the image-forming unit is 60 mm or less.

DETAILED DESCRIPTION OF THE INVENTION

First Embodiment

Figure 1:
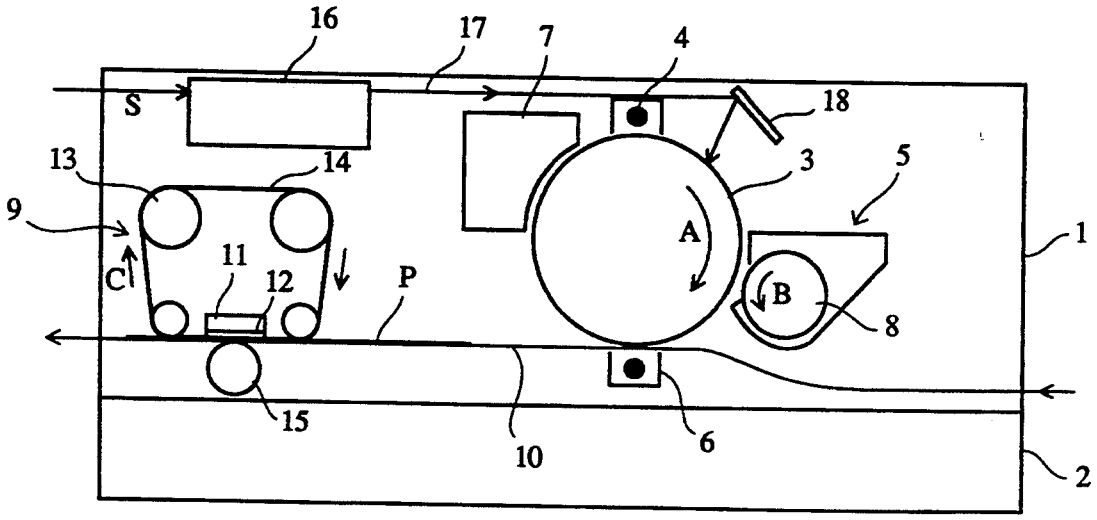
FIG. 1 is a schematic view showing an electrophotographic printer according to the first embodiment of the present invention.

Referring to FIG. 1, the image-forming unit 1 integrally mounted to a control unit 2 comprises a cylindrical photosensitive drum 3 having an outer surface coated with a photosensitive layer (not shown) made of zinc oxide or an organic semiconductor, which is rotatable in the direction shown by the arrow A. Disposed in the vicinity of an outer surface of the cylindrical photosensitive drum 3 are an electric charger 4, a developer 5, a transfer means 6, and a cleaning means 7. The developer 5 contains a magnet roll 8 rotatable in the direction shown by the arrow B.

The fixing means 9 is disposed on the downstream side of the cylindrical photosensitive drum 3 along a path 10 of a recording paper P in the image-forming unit 1. The fixing means 9 is constituted by a heating means comprising a substrate 11 made of aluminum and a heater means 12 made of an electric resistance material and formed on the substrate 11, a plurality of rollers 13, an endless belt 14 movable along a path around the heater means 12 and the rollers 13 in the direction shown by the arrow C, and a rotatable pressure roll 15 disposed in the vicinity of the heater means 12 for pressing the recording paper P to the heater means 12 via the belt 14.

The endless belt 14 may have a thickness of 100 μm or less, preferably 20–50 μm, and may be made of a heat-resistant material such as polyimide, polyetherimide, etc. The endless belt 14 is coated with a parting layer made of fluoroplastics such as polytetrafluoroethylene (PTFE), perfluoroalkoxy resins (PFA), etc. at a thickness of 1–20 μm, particularly about 10 μm on the surface facing the toner image on the recording medium P (lower surface in FIG. 1). The pressure roll 15 is coated with an elastic layer having a good parting property such as a silicone rubber, etc. The pressure roll 15 may come into contact with the heater means 12 via the belt 14 and the paper P at a linear pressure of 0.1–1 kg/cm, preferably 0.5 kg/cm.

A laser scanner 16 is mounted to an upper part of the image-forming unit 1. In response to an electric signal S corresponding to information or image to be printed, the laser scanner 16 supplies a laser beam 17 toward a mirror 18, by which the laser beam 17 is reflected and impinges a surface of the cylindrical photosensitive drum 3. The driving mechanism (not shown) and the laser scanner 16 contained in the image-forming unit 1 are electrically connected to the control unit 2, so that their operations are controlled.

When the electrostatic latent image-bearing member 3 has an outer diameter exceeding 40 mm and the magnet roll 8 has an outer diameter exceeding 30 mm, the image-forming unit 1 becomes too high, whereby the electrophotographic printer cannot be made thin and portable. Therefore, the electrostatic latent image-bearing member 3 should have an outer diameter of 40 mm or less, and the magnet roll 8 should have an outer diameter of 30 mm or less, so that the height of the image-forming unit 1 can be made as small as 60 mm or less. A peripheral speed of the image-bearing member is preferably 60 mm/sec or less, more preferably 20–50 mm/sec. Accordingly, the fixing speed is also preferably 60 mm/sec or less, more preferably 20–50 mm/sec. With these peripheral speed and fixing speed (both called "process speed"), the electrostatic latent image-bearing member 3 having as small an outer diameter as 40 mm or less can be used, and the convey speed of the magnetic developer can be suppressed, which makes it possible to reduce the outer diameter of the magnet roll 8 to 30 mm or less. Therefore, a torque necessary for rotating the magnet roll 8 can be reduced, which in turn makes a driving means smaller.

The height of the image-forming unit 1 can be reduced to as small as 55 mm, by reducing the outer diameter of the photosensitive drum 3 having a photosensitive layer made of an organic semiconductor to 30 mm and the outer diameter of the magnet roll 8 to 18 min. Such a small electrophotographic printer is easily carried with a hand.

Incidentally, the belt 14 used in the electrophotographic printer 1 of the first embodiment is not restricted to an endless belt, but the belt 14 may have a limited length, if it is wound around a pair of rolls apart from each other, and if these rolls are rotated in the same direction. In this case, the belt is wound around one roll while it is unwound from another roll at any time, whereby the belt moves back and forth through a gap between the heating member 12 and the pressure roll 15.

The electrophotographic printer having the above structure is operated as follows:

After putting the image-forming unit 1 into an operating condition via the control unit 2, an electric signal S corresponding to information or image is supplied to the laser scanner 16. Next, the photosensitive drum 3 is charged uniformly by a charger 4, and the laser beam 17 generated by the laser scanner 16 according to the electric signal S is impinged onto the charged surface of the photosensitive drum 3 to form an electrostatic latent image. The electrostatic latent image is developed with a magnetic toner conveyed on a cylindrical sleeve of the developing means 5 by the rotation of the magnet roll 8. The developed image (toner image) is then transferred onto a recording paper conveyed along the recording paper path 10 by means of the transfer means 6. After transfer of the developed toner image, the magnetic toner remaining on the photosensitive drum 3 is removed by a cleaner 7 having a cleaning blade (not shown), and the next electrostatic latent image is formed on the photosensitive drum 3.

The recording paper P carrying the toner image is conveyed to the fixing means 9, where the recording paper P passes through a gap between the belt 14 movable in contact with the heating member 12 and the pressure roll 15. Since heat supplied from the heating member 12 is transmitted to the toner image on the recording paper P via the belt 14, the binder resin in the magnetic toner is melted, whereby the toner image is fixed to the recording paper P.

In this small electrophotographic printer, the process speed (the peripheral speed of the image-bearing member and the fixing speed) is preferably 60 mm/sec or less, more preferably 20–50 mm/sec. At this process speed, preferred operating conditions are, for instance, as follows:

Peripheral speed of the photosensitive drum 3=20 mm/sec.,

Fixing temperature=130° C., and

Pressing force of the pressure roll 15=0.5 kg/cm.

Under these conditions, image formed on the recording paper showed good image density and resolution with good fixability.

Second Embodiment

Figure 2:
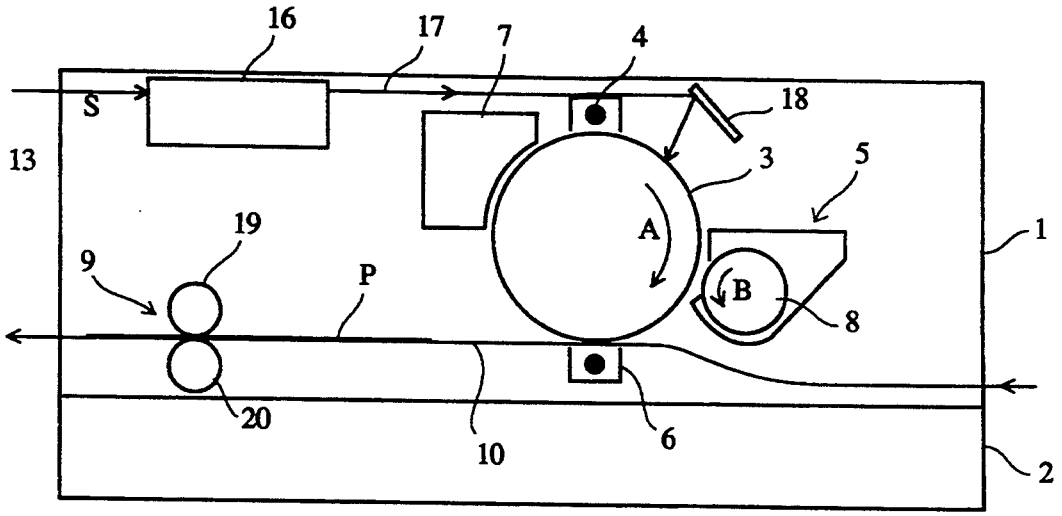
FIG. 2 is a schematic view showing an electrophotographic printer according to the second embodiment of the present invention.

FIG. 2 shows another example of the electrophotographic printer of the present invention, in which the same reference numerals are assigned to the same components as in FIG. 1. In FIG. 2, the fixing means 9 is constituted by a heating roll 19 and a pressure roll 20 both rotatable in pressed contact with each other. Each of the heating roll 19 and the pressure roll 20 has an outer diameter of 20 mm or less, preferably 10–20 mm, and they are pressed to each other at a linear pressure of 0.1–1 kg/cm, preferably 0.5 kg/cm. The heating roll 19 may be composed of a cylindrical core member made of aluminum, etc., a heating member made of an electric resistance material and formed on an outer surface of the core member, and a parting layer made of PTFE having a thickness of 1–20 μm, particularly about 10 μm. On the other hand, the pressure roll 20 may be composed of a cylindrical core member made of the same material as in the heating roll 19, and an outer layer made of a silicone rubber and formed on an outer surface of the core member.

In this embodiment, the fixing means may be constituted by a pair of fixing rolls each having a diameter of 20 mm or less, preferably 10–20 mm. Specifically, the fixing means comprises a heat roll containing a heat source such as a halogen lamp, or a heat roll 19 of a so-called direct heat type, an outer surface of which is provided with a heat-generating member made of an electric resistance material, etc.

Incidentally, the heating roll 19 may be constituted by a core member made of a ceramic material and a heating member embedded in the core member.

In the electrophotographic printer in this second embodiment, the process speed (the peripheral speed of the image-bearing member and the fixing speed) is preferably 60 mm/sec or less, more preferably 20–50 mm/sec.

With the electrophotographic printer having the above constitution according to the second embodiment, image was formed under the same conditions as above. As a result, it was confirmed that as good image as in the electrophotographic printer of the first embodiment can be formed.

Magnetic Developer

The magnetic developer usable in the present invention is (a) a magnetic toner consisting mainly of a binder resin and a magnetic powder, or (b) a mixture of a magnetic toner and a magnetic carrier. The binder resins include styrene resins such as polystyrene, styrene-acrylic copolymers, styrene-butadiene copolymers, etc.

The magnetic powder includes compounds or alloys containing ferromagnetic metals such as iron, cobalt, nickel, etc., for instance, ferrite, magnetite, etc. To disperse the magnetic powder in the binder resins uniformly, it is preferable that the magnetic powder has an average diameter of 0.01–3 μm. The content of the magnetic powder in the magnetic toner is preferably within the range of 10–80 weight %, more preferably 20–60 weight %.

The magnetic toner may contain various additives usable in usual developers, such as charge-controlling agents such as nigrosine dies or azo dies containing metals, parting agents such as olefin polymers, fluidity improvers, fillers, etc. In order to avoid the decrease in a fixability, the total amount of the additives is preferably 15 weight % or less.

The magnetic loner can be prepared by known methods such as a pulverization method, a spray-drying method, or a suspension polymerization method. The average diameter of the magnetic toner is preferably within the range of 5–15 μm, more preferably 7–10 μm.

The magnetic carrier usable in the present invention is produced from iron powder, iron oxide (for instance, magnetite), soft ferrite (for instance, Ni—Zn ferrite, Mn—Zn ferrite, Cu—Zn ferrite, Ba—Ni—Zn ferrite), magnetic powder bonded with resin binders, etc. To prevent carrier adhesion and fogging, the magnetic carrier preferably has a $\sigma s$ of 40–90 emu/g (measured in a magnetic field (maximum: 10 kOe) by a sample vibration-type magnetometer (Model VSM-3, manufactured by Toei Industry Co., Ltd.) and an average diameter of 20–105 μm. Also, magnetic powder coated with a resin having an average diameter of 10–100 μm may be used.

As described above in detail, according to the present invention, the electrophotographic printer can be made thin because of the above-described structure. Therefore, it is convenient as a portable printer. Also, since rollers supporting a belt or fixing rolls in the fixing means have small diameters, it is possible to prevent the recording medium from being wound around the rolls in the fixing means without using separation fingers. Therefore, the fixing means can have a simplified structure, making it possible to reduce the weight and cost of the image-forming unit.

What is claimed is:

1. An electrophotographic printer comprising an image-forming unit comprising a cylindrical, electrostatic latent image-bearing member, an electrostatic latent image-forming means, a developing means disposed near said electrostatic latent image-bearing member and equipped with a magnet roll for a magnetic developer containing magnetic toner, a transfer means disposed near said electrostatic latent image-bearing member for transferring the developed image on the surface of said electrostatic latent image-bearing member onto a recording medium, a cleaning means disposed near said electrostatic latent image-bearing member for cleaning the surface of said electrostatic latent image-bearing member after transferring of said developed image, and a fixing means disposed downstream of said electrostatic latent image-bearing member for heat-fixing said developed image onto said recording medium, wherein an outer diameter of said electrostatic latent image-bearing member is 40 mm or less, an outer diameter of said magnet roll is 30 mm or less, and a height of said image-forming unit is 60 mm or less, and wherein a process speed equal to a peripheral speed of said image-bearing member and a fixing speed is 60 mm/sec or less.

2. The electrophotographic printer according to claim 1, wherein said fixing means is constituted by a pair of fixing rolls each having a diameter of 20 mm or less.

3. The electrophotographic printer according to claim 1, wherein said fixing means is constituted by a stationary heating means, a belt movable in contact with said heating means and a pressure means disposed opposite said heating means for pressing said belt to said heating means.

4. The electrophotographic printer according to claim 2, wherein the process speed is 20–50 mm/sec or less.

5. The electrophotographic printer according to claim 3, wherein the process speed is 20–50 mm/sec or less.

* * * * *